US010195766B2

(12) United States Patent
Rostvall et al.

(10) Patent No.: US 10,195,766 B2
(45) Date of Patent: Feb. 5, 2019

(54) CUTTING TOOL

(71) Applicant: ATLAS COPCO SECOROC AB, Fagersta (SE)

(72) Inventors: Tomas Rostvall, Stockholm (SE); Christian Heydeck, Fagersta (SE)

(73) Assignee: EPIROC DRILLING TOOLS AKTIEBOLAG, Fagersta (SE)

( * ) Notice: Subject to any disclaimer, the term of this patent is extended or adjusted under 35 U.S.C. 154(b) by 0 days.

(21) Appl. No.: 15/570,477

(22) PCT Filed: May 3, 2016

(86) PCT No.: PCT/SE2016/050404
§ 371 (c)(1),
(2) Date: Oct. 30, 2017

(87) PCT Pub. No.: WO2016/178626
PCT Pub. Date: Nov. 10, 2016

(65) Prior Publication Data

US 2018/0142432 A1 May 24, 2018

(30) Foreign Application Priority Data

May 7, 2015 (SE) ..... 1550578

(51) Int. Cl.
*E21C 35/18* (2006.01)
*B28D 1/18* (2006.01)

(52) U.S. Cl.
CPC ..... *B28D 1/186* (2013.01); *E21C 35/18* (2013.01); *E21C 2035/1803* (2013.01)

(58) Field of Classification Search
CPC ..... E21C 35/18; B28D 1/186
See application file for complete search history.

(56) References Cited

U.S. PATENT DOCUMENTS 7,396,086 B1 7/2008 Hall et al.
2008/0284234 A1 11/2008 Hall et al.
2010/0295360 A1 11/2010 Kramer et al.
(Continued)

FOREIGN PATENT DOCUMENTS

AU 2010246884 A1 12/2011
CN 205154158 U 4/2016

OTHER PUBLICATIONS

International-Type Search Report of SE 1550578-7 dated Nov. 26, 2015.

(Continued)

*Primary Examiner* — Janine M Kreck
(74) *Attorney, Agent, or Firm* — Venable LLP; Jeffri A. Kaminski

(57) ABSTRACT

A cutting tool is provided. The cutting tool comprises a tip, a body and a shank. The tip has a tip radius and a tip length. The body has a body radius and a body length between the shank and a recess portion along a longitudinal axis of the body. The recess portion comprises a wall which forms a recess with a depth into the body for retaining a major part of the tip length within the recess. The body radius at half the depth of the recess does not exceed two tip radiuses. The tip is made of a hard metal alloy with a hardness of at least 1300 HV50 and the body is made of a steel alloy with a hardness of at least 450 HV30.

15 Claims, 2 Drawing Sheets

(56) References Cited

U.S. PATENT DOCUMENTS

| | | | | |
|---|---|---|---|---|
| 2013/0327577 | A1* | 12/2013 | Macintyre | E21C 35/18<br>175/428 |
| 2014/0054951 | A1* | 2/2014 | Bookhamer | E21C 35/183<br>299/113 |
| 2014/0262541 | A1* | 9/2014 | Parsana | E21B 10/567<br>175/428 |
| 2015/0137579 | A1* | 5/2015 | Lachmann | B28D 1/188<br>299/10 |
| 2015/0300166 | A1* | 10/2015 | Ries | E21C 35/1933<br>299/105 |

OTHER PUBLICATIONS

International Search Report of PCT/SE2016/050404, dated Jul. 12, 2016.
Written Opinion of PCT/SE2016/050404, dated Jul. 12, 2016.

* cited by examiner

CUTTING TOOL

CROSS-REFERENCES TO RELATED APPLICATIONS

This application is a U.S. National Stage application of PCT/SE2016/050404, filed 3 May 2016 and published on 10 Nov. 2016 as WO 2016/178626, which claims the benefit of Swedish Patent Application No. 1550578-7, filed 7 May 2015, all of which are hereby incorporated by reference in their entireties.

TECHNICAL FIELD

Embodiments herein relate to a cutting tool.

BACKGROUND

When a surface layer of a paved area is exposed to different temperatures, ageing and vehicles driving over the surface, it may become worn and uneven. For example, heavy vehicles which starts and stops in front of a traffic light, causes the surface layer to shear relatively lower layers. The surface layer can be milled off, and a material of the surface layer may in some cases be recycled and used as aggregate when a new surface layer is paved to replace the old one.

The process of removing the surface layer can be referred to as asphalt milling, profiling, cold planning or pavement milling. During such a process a milling machine or cold planner provided with a large rotating drum equipped with cutting tools can be used. The drum, when rotating, grinds and removes the surface layer of e.g. a road or a parking lot. The cutting/milling is also commonly performed on various kinds of concrete surfaces, such as at bus stops, bridges and runways.

Such a drum can comprise a plurality of tool holders or attachment portions for cutting tools. An example of such a cutting tool is disclosed in US20140232172A1. In US20140232172A1, the cutting tool comprises a body, a shank which can be attached to a drum, and a cutting element.

Cutting tools are also used in several other applications, such as during coal mining or mechanical processing of rocks etc. Cutting tools may also be used during rotary drilling, such as described in WO2010099512A1. Cutting tools may also be referred to as milling tools or milling bits.

A body of the type disclosed in US20140232172A1 can be made of metal and the cutting element can be made of a hard material. When a drum with a number of cutting tools attached to a periphery of the drum is rotated on a paved surface each cutting element on each cutting tool shears away material and hereby the surface layer of the paved surface is removed.

The cutting tool disclosed in US20140232172A1 may be suitable in some applications but there remains a need for a cutting tool which can be used for a longer amount of time before it is worn out. There also remains a need for a cutting tool which decreases forces between a surface to be milled and a tool holder and also distributes the forces between the surface to be milled and the tool holder in an advantageous manner. Thus, a problem in this regard is that wear properties and required cutting forces of prior art cutting tools are not sufficiently good.

SUMMARY

Embodiments herein aim to provide a cutting tool with better wear properties and lower required cutting forces than prior art cutting tools.

According to an embodiment, this is provided by a cutting tool comprising a tip, a body and a shank for attaching the cutting tool to a tool holder, the tip having a tip radius and a tip length between a first end and a second end of the tip along a longitudinal axis of the tip, the body having a body radius and a body length between the shank and a recess portion along a longitudinal axis of the body, the recess portion comprising a wall which forms a recess with a depth into the body for retaining a major part of the tip length within the recess such that the longitudinal axes of the tip substantially coincides with the longitudinal axis of the body, wherein the body radius at half the depth of the recess is less than two times the tip radius, that the tip is made of a hard metal alloy with a hardness of at least 1300 HV50 and that the body is made of a steel alloy with a hardness of at least 450 HV30.

Since the body radius at half the depth of the recess is less than two times the tip radius the wall which forms the recess will be relatively thin or slender in comparison with the radius of the tip. This shape combined with a tip hardness of at least 1300 HV50 and a body hardness of at least 450 HV30 has surprisingly proven to work exceptionally well during milling operations. The tip hardness refers to the hardness of the hard metal alloy which forms the tip and the body hardness refers to the hardness of the steel alloy which forms the body. Test results are provided in the detailed description of this application. The combination of the above shape, tip hardness and the body hardness provides for an even wear on the body and the tip during milling. Due to the slender shape, the tip is subjected to relatively small bending forces relatively recess walls of the body during milling. Hereby it is possible to use a relatively hard and brittle material for the tip. This increases time of use before the cutting tool is considered to be worn out. Due to the slender shape also the total forces on the bit body are decreased. Hereby it is also possible to use a relatively hard, stiff and brittle steel material for the body. This also increases time of use before the cutting tool is considered to be worn out. The relatively stiff steel body improves the distribution of bending forces acting on the tip which decreases the risk for brittle failure of the tip.

The slender shape of the tip and the body will result in decreased cutting forces and thereby less vibration transferred to the tool holder to which the cutting tool is attached and accordingly also to a milling machine which comprises the tool holder and the cutting tool. As mentioned above, the tool holder may be arranged e.g. on/at a rotatable drum. Forces between the surface to be milled and the tool holder are hereby decreased. Hereby less power and energy are required from the milling machine and fuel consumption is decreased.

With the above design, tip hardness and body hardness, the resulting wear of the steel body is approximately the same as for the hard metal tip during milling. When the relatively thin and slender steel body is continuously worn during a milling operation the tip is continuously exposed. The cutting tool will therefore stay relatively sharp, i.e. it gets less blunt during cutting as compared to prior art tips. Forces will therefore be kept relatively low and constant. The steel wall of the body protects the tip for a relatively long time during milling. Hereby a relatively large portion, such as 50-90%, of a tip length can be worn down before the cutting tool has to be replaced. The tip length can hereby be optimized such that the tip extends into the body to a depth corresponding to a depth just before the wear reaches the tool holder or the drum during cutting/milling, This is advantageous since it is difficult and costly to replace the tool holder.

An operator of the cutting/milling machine will thus have a constant performance just until it is time to replace the cutting tools. He/she is made aware of the necessity of replacing the cutting tools as a forward movement of the cutting/milling machine will almost come to a stop before the wear reaches the tool holder or the drum. The appropriate time to exchange the cutting tools is thus easily recognized by the operator.

A cutting tool with the combination of the above-mentioned shape, tip hardness and body hardness has proven to have excellent wear properties both during milling of asphalt surfaces, concrete surfaces and other types of surfaces.

According to some embodiments the body radius along the depth of the recess is less than two times the tip radius. According to some embodiments the body radius along the depth of the recess is less than 1.5 times the tip radius. According to some embodiments the body radius at half the depth of the recess is less than 1.7 times the tip radius. The relatively thin, hard and stiff recess wall thus retains the tip safely and the contact surface between the tip and the body is relatively large. The relatively large contact surface also improves heat transfer from the tip to the body. The tip and the wall are evenly worn when the cutting tool is used and hereby even wear and low and even bending forces on the tip are achieved during the entire time of use before the cutting tool is considered to be worn out.

According to some embodiments, the tip is made of a hard metal alloy with a hardness of at least 1350 HV50 and the body is made of a steel alloy with a hardness of at least 465 HV30. Hereby a long time of use before the cutting tool is considered to be worn out is achieved.

According to some embodiments, the tip is made of a hard metal alloy with a hardness of at least 1400 HV50 and the body is made of a steel alloy with a hardness of at least 480 HV30. This provides for excellent wear properties and a long time of use before the cutting tool is considered worn out. According to some embodiments the tip is made of diamond composite with a hardness of at least 1400 HV30.

According to some embodiments the tip is made of a hard metal alloy with a hardness between 1400-1500 HV50 and the body is made of a steel alloy with a hardness between 480-550 HV30. This combination of the tip hardness and the body hardness has proven to work well in many applications such as e.g. during milling of asphalt and concrete.

According to some embodiments the body radius increases continuously from the recess portion to the shank. With a continuous increase of the body radius from a smaller radius at the recess portion towards a larger radius at the body portion facing the shank a initially small increase of forces between the cutting tool and the ground is achieved. An operator of the cutting/milling machine will thus have a constant performance. In some embodiments the shape of the body is concave along at least a part of its length. The increase of the body radius may be smaller near the recess portion and larger near the shank.

According to some embodiments the body radius increases continuously from the recess portion to the shank along a smooth curve. The smooth curve allows forces to increase in a foreseeable manner as the cutting tool becomes worn. It further increases the heat transfer from the tip. This will decrease the temperature of the tip and hereby thermal degradation is avoided or at least mitigated.

According to some embodiments a periphery of the body comprises longitudinal grooves. The longitudinal grooves increase the wear of steel alloy body in the longitudinal direction when the cutting tool is used, in particular near the shank. This may partially compensate a decreased wear due to the slightly increased body radius and hereby the wear over the body length will be more even. The longitudinal grooves also help the cutting tool to rotate when it hits the ground during a milling operation. Hereby the cutting tool will be evenly worn along the tip and its periphery. The grooves may also function as "chipbreakers", i.e. they will improve breaking and removal of surface layer material.

According to some embodiments the recess comprises a wall portion and a bottom portion with a bottom-radius between the wall portion and the bottom portion. The bottom-radius between the wall portion and the bottom portion reduces the risk for cracks in the body near the bottom of the recess. According to some embodiments the bottom radius is at least 1 mm, preferably at least 1.5 mm. A bottom radius of at least 1 mm, preferably at least 1.5 mm may facilitate a corresponding large radius in the bottom of the tip which hereby also reduces the risk for cracks in the tip. It has been proved that these radii may be advantageous in applications where a wall thickness near the bottom of the recess is relatively small, as described in embodiments herein.

According to some embodiments the body comprises a ductile plate arranged in a bottom portion of the recess. A ductile plate arranged in a bottom portion of the recess transfer blows and forces between the tip and the body during milling operations. Hereby cracking of the tip is avoided. In addition, a ductile plate, made of e.g. cupper, improves thermal conduction from the tip to the body. Such a ductile plate can have a thickness of e.g. 0.5-1 mm.

According to some embodiments the tip is retained within the recess by shrink-fitting. According to some other embodiments the tip is retained within the recess by press-fitting. According to yet some other embodiments the tip is retained within the recess by a combination of shrink-fitting and press fitting. Shrink fitting and/or press fitting provides for a secure and cost efficient retaining of the tip within the recess, in particular when the wall which forms the recess is relatively thin.

According to some embodiments the first tip end is tapered with a first angle relatively the longitudinal axis of the tip, the second tip end is tapered with a second angle relatively the longitudinal axis of the tip and a cylindrical tip body extends between the first tip end and the second tip end. The tapered first and second tip ends facilitates fitting, production of the tip and prevents chipping of the tip. The first angle can be e.g. between 20 and 60 degrees. The second angle can be e.g. between 5 and 45 degrees.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings. Like numbers refer to like elements throughout. Well-known functions or constructions will not necessarily be described in detail for brevity and/or clarity.

Figure 1:
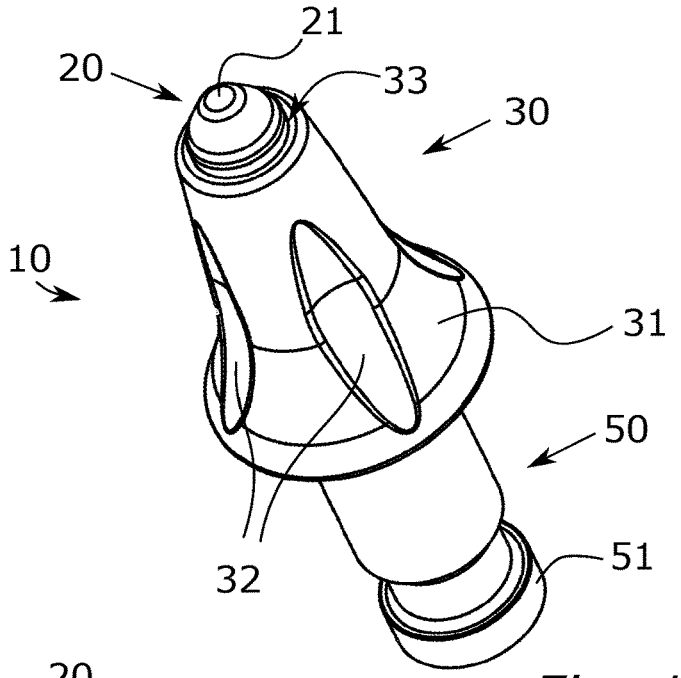
FIG. 1 illustrates a perspective view of a cutting tool according to some embodiments.

FIG. 1 illustrates a cutting tool 10 in perspective view from above. The cutting tool 10 comprises a tip 20, a body 30 and a shank 50 for attaching the cutting tool 10 to a tool holder.

The shank 50 can be attached e.g. to a complementary shaped attachment portion of a tool holder of a rotatable drum or the like. The shank 50 can comprise one or more notches, flanges 51, protrusions or similar which may be used for securely attaching the shank 50 to a tool holder of any kind, such as the aforementioned rotatable drum. In some embodiments the shank 50 is arranged to be attached to a sleeve or collar which in turn is attached to the tool holder. The shank 50 can be attached to the tool holder in a fixed or rotatable manner. The body 30 and the shank 50 can be integrally formed or may in some embodiments be separately formed and then attached to each other.

Figure 2:
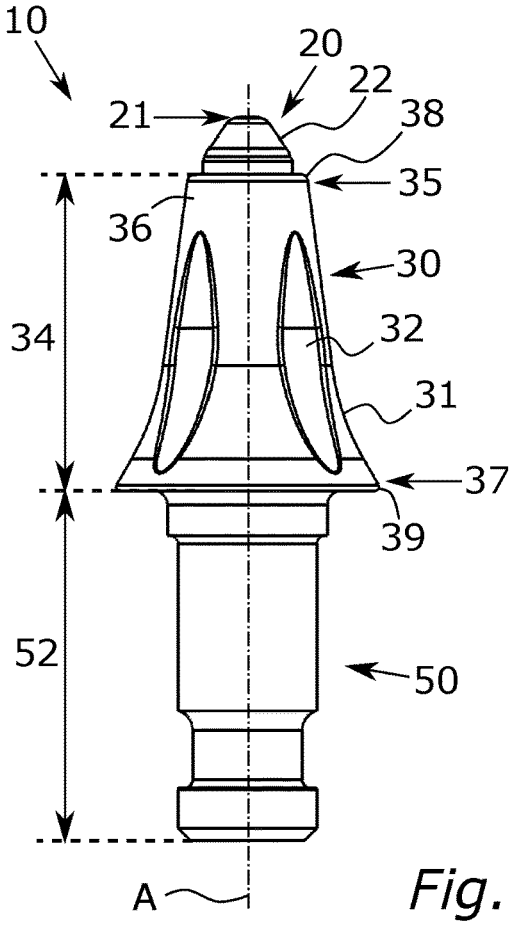
FIG. 2 is a side view of the cutting tool in FIG. 1.

In the embodiment of FIG. 1, a periphery 31 of the body 30 comprises longitudinal grooves 32. The body 30 can be provided with e.g. 2-12 grooves 32 which extends along the periphery 31 of the body 30. In some embodiments, the periphery 31 of the body 30 comprises a number of protrusions (not shown). The grooves 32 and/or the protrusions facilitate rotation of the cutting tool 10 around a longitudinal axis during cutting and/or milling. The longitudinal axis is illustrated in FIG. 2. In some embodiments, the periphery 31 is formed without any grooves or protrusions.

In FIG. 1, a first end 21 of the tip 20 is illustrated. In the FIG. 1 embodiment the remainder of the tip 20 is retained within a recess 33 of the body 30.

The tip 20 is made of a hard metal, such as a carbide alloy. For example, the tip 20 is made of cemented carbide, tungsten cemented carbide, silicone carbide, cubic carbide, cermet, polycrystalline cubic boron nitride, silicone cemented diamond, diamond composite or any other material with a hardness of at least 1300 HV50. HV50 is hardness measured by Vickers hardness test and is commonly used for hard material-testing. Since hardness of a material can be measured by different kind of tests, it is understood that the tip 20 is made of a material with a hardness of at least 1300 HV50 or a corresponding hardness measured by other tests. The tip 20 can have a toughness of at least 11 K1c. The toughness, also referred to as fracture toughness, can e.g. be measured by the Palmqvist method as described in US20110000717A1.

Preferable, the ISO standards ISO 3878:1983 (Vickers hardness test for Hard Metals) and ISO 6507:2005 (Vickers hardness test Metallic Materials) are be used for hardness measurements. If measurements have been done according to another established method conversion tables according to ISO 18265:2013 (Hardness conversion Metallic Materials) for metallic materials may be used. For toughness measurements the ISO standard ISO 28079:2009 (Palmqvist test for Hard Metals) is preferably used.

The body 30 is made of a steel alloy with a hardness of at least 450 HV30 or a corresponding hardness measured by other tests. HV30 is hardness measured by Vickers hardness test and is commonly used for testing hardness of steel alloys etc. The body 30 can for example be made of steel, such as of steel comprising about, in weight-percent: 1% Cr, 0.2% Mo, 0.8% Mn, 0.4% C, 0.3% Si, 0.025% P and 0.035% S. The tip 20 can for example comprise 5-7% Co and 93-95 WC, such as about 6% Co and 94% WC. The hardness depends e.g. on the Cobalt content and the particle size of the material.

The below charts illustrate test result from tests where different cutting tools with different tip hardness and body hardness have been tested. The hardness of the tip is measured with HV50 and the hardness for the steel body is measured with HV30. With reference to chart 1 below, cutting tool "G" is an example of a cutting tool 10 according to claimed embodiments herein. Cutting tools A, B, C, D, E and F are other tested cutting tools according to the state of the art. Cutting tools E and F are variants of the cutting tool G with corresponding geometrical shapes but different combinations of hardness. As illustrated below relative service life for cutting tool G is much larger than for cutting tools E and F.

CHART 1

| Cutting tool | Tip-HV50 | Body-HV30 |
|---|---|---|
| A | 1170 | 340-350 |
| B | 1170 | 484-515 |
| C | 1150 | 420-490 |
| D | 1150 | 580-590 |
| E | 1020 | 410-430 |
| F | 1460 | 410-430 |
| G | 1460 | 500 |

Chart 2 below illustrates test results for the cutting tools A-G after the cutting tools have been tested. During this test the cutting tools were attached to a rotary drum and used for milling a distance of 2000 meters. During approximately 1000 m of the distance, the cutting tools were milling asphalt. Moreover, during approximately 1000 m of the distance, i.e. the remaining portion of the distance, the cutting tools were milling concrete. The milling depth was 3-5 cm and the ambient temperature was about 5° Celsius.

CHART 2

| Cutting tool | Approximate wear (mm) | Relative service life |
|---|---|---|
| A | 7.5 | 0.60 |
| B | 4.5 | 1.00 |
| C | 6.5 | 0.69 |
| D | 7.5 | 0.60 |
| E | 6.5 | 0.69 |
| F | 5.5 | 0.82 |
| G | 3.5 | 1.29 |

Relative service life is defined as inverted wear compared with the best prior-art-cutting tool, i.e. in this test cutting tool "B". As an example, relative service life for cutting tool A in Chart 2 is thus 4.5 mm/7.5 mm=0.6. Relative service life for cutting tool G in Chart 2 is thus 4.5 mm/3.5 mm=1.29.

A second test with deeper depth of cut was also performed. Chart 3 below illustrates test results for the cutting tools A and G after the cutting tools have been tested. During the second test the cutting tools were attached to a rotary drum and used for milling a distance of 1300 meters. The cutting tools were milling asphalt. The milling depth was 5-10 cm and the ambient temperature about 8° Celsius. As above, relative service life is defined as inverted wear compared to best prior art cutting tool, in this case bit A.

CHART 3

| Cutting tool | Approximate wear (mm) | Relative service life |
|---|---|---|
| A | 3.6 | 1.00 |
| G | 1.7 | 2.12 |

Several tests were performed. The above charts illustrate some examples of results achieved during the tests. The entire hardness ranges of the claimed embodiments performed very well and had longer relative service life, i.e. a longer amount of time before it was worn out, than cutting tools according to the state of the art. As indicated from the tests, cutting tools according to embodiments herein proved to be very durable and efficient throughout the tests as compared to cutting tools according to the state of the art.

FIG. 2 illustrates the cutting tool 10 from a side perspective. The body 30 has a body length 34 which extends between the shank 50 and a recess portion 35 along a longitudinal axis A of the body 30. The body length 34 thus includes the full length of the body 30, i.e. from the shank 50 to the uppermost end of a wall 36 of the recess portion 35 in FIG. 2. The wall 36 thus forms the recess 33. The tip 20 can be retained within the recess 33 e.g. by shrink-fitting, press-fitting, soldering, welding or the like. The tip is hereby attached into the body 30 in a firm and secure manner.

A major part of the cutting tool 10 can have a shape that is substantially rotational symmetric with reference to the longitudinal axis A of the cutting tool 10. Thus, when the tip 20 is retained within the recess 33 a longitudinal axis of the tip 20 substantially coincides with the longitudinal axis of the body 30. The longitudinal axis A is then a longitudinal centre-axis for the entire cutting tool 10, i.e. for the tip 20, for the body 30 and for the shank 50.

In some embodiments, the first tip end 21 comprises a chamfered or tapered portion 22. The shape of the first tip end 21 can then be seen as substantially frustoconical. A surface of such tapered portion can extend e.g. with an angle 20-60 degrees relatively the longitudinal axis A.

As illustrated in FIG. 2, a radius of the body 30 increases continuously from the recess portion 35 towards a body base portion 37 near the shank 50. In the embodiment of FIG. 2, the body radius increases continuously from the recess portion 35 towards the body base portion 37 near the shank 50 along a smooth curve. The periphery 31 can end with first periphery radius 38 at the recess portion 35 and with a second periphery radius 39 at the body base portion 37 closest to the shank 50. In FIG. 2 also a length 52 of the shank 50 is illustrated.

In FIG. 2 also the first tip end 21 and grooves 32 of the body 30 are illustrated.

Figure 3:
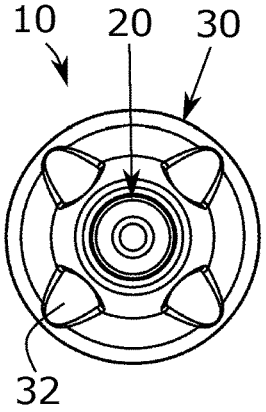
FIG. 3 is a top view of the cutting tool in FIG. 1.

FIG. 3 illustrates the cutting tool 10 from above, i.e. as seen along the longitudinal axis A. In FIG. 3 the tip 20, the body 30 and grooves 32 are illustrated.

Figure 4:
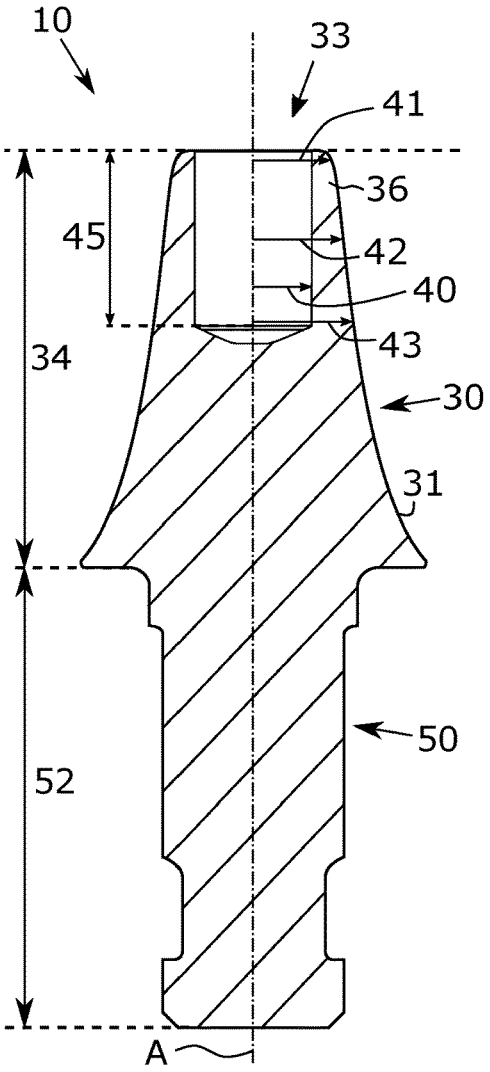
FIG. 4 is a cross sectional view of the cutting tool without the tip according to some embodiments.

FIG. 4 illustrates a cross-section of the body 30 with its body length 34 and the shank 50 with its shank length 52 without any tip mounted in the recess 33. A thickness of the wall 36 extends between a recess radius 40 and a body radius 41, 42, 43, i.e. a radius extending from the longitudinal axis A out to the periphery 31 of the body 30. As illustrated, the body radius 41, 42, 43 increases from the first periphery radius at the recess portion towards the shank 50.

In some embodiments, a first body radius 41, which is a radius of the body 30 adjacent to the first periphery radius 38, is between 1.1 and 1.8 times the recess radius 40, preferably about 1.3-1.6 times the recess radius 40. According to a first example, the recess radius 40 may be about 5.5 mm and the first body radius 41 may be about 8.5 mm. The first body radius 41 is then about 1.55 times the recess radius. According to a second example, the recess radius 40 may be about 5.5 mm and the first body radius 41 may be about 7.25 mm. The first body radius 41 is then about 1.32 times the recess radius.

Figure 5:
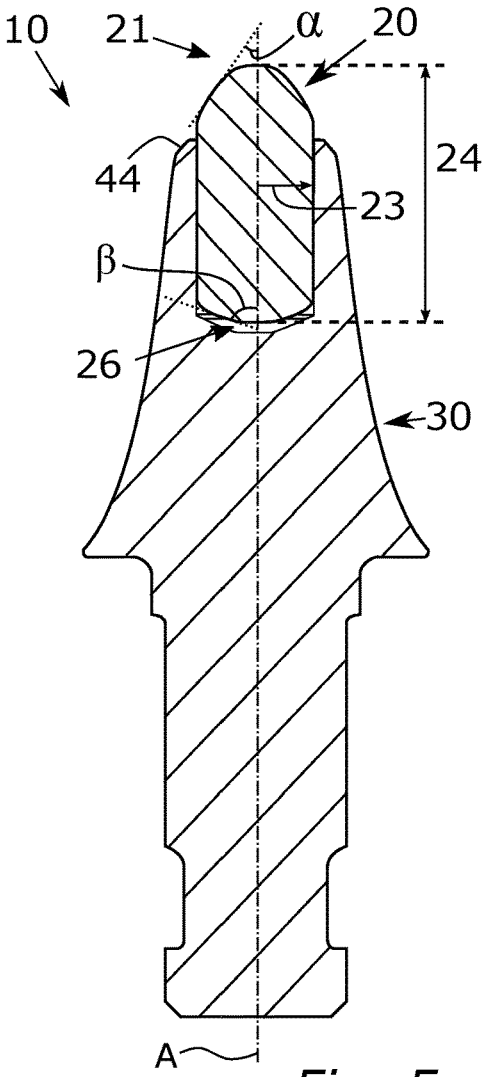
FIG. 5 is a cross sectional view of the cutting tool according to some other embodiments.

In some embodiments, a second body radius 42, which is a radius of the body 30 at approximately half the depth of the recess 33, is between 1.5 and 2 times the recess radius 40. According to some embodiments the second body radius 42 is 1.2-1.7 times the recess radius 40. The recess radius 40 is, when a tip is tightly mounted in the recess, also referred to as a tip radius. The tip radius is illustrated in FIG. 5. According to an example, the recess radius 40 can be about 5.5 mm and the second body radius 42 can be about 8.9 mm. The second body radius 42 is then about 1.62 times the recess radius.

According to some embodiments the third body radius 43, which is a radius of the body 30 at a bottom of a cylindrical portion of the recess 33, is 1.6-2.2 times the recess radius 40. In some embodiments a third body radius 43, is between 1.2 and 1.6 times the recess radius 40. According to an example embodiment the recess radius 40 can be about 5.5 mm and the third body radius 43 can be about 10 mm. The third body radius 43 is then about 1.82 times the recess radius.

In some embodiments the bottom portion of the recess 33 is substantially flat. In the embodiment illustrated in FIG. 3 the bottom portion of the recess 33 is slightly concave or tapered. Hereby the bottom portion may provide support to a complementary convex or tapered portion of a mounted tip. A depth 45 of the recess 33 can be e.g. between 15-20 mm, between 20-25 mm or between 25-35 mm. A total length of the cutting tool can be e.g. 50 mm.

In some embodiments a ductile plate (not shown) is arranged between a mounted tip and the bottom of the recess 33. Such a ductile plate may be made of cupper or other ductile material.

In FIG. 5, a cross section of the cutting tool 10 is illustrated when the tip 20 is mounted in the recess of the body 30. The cutting tool 10 of FIG. 5 generally resembles the cutting tool of FIG. 2, but the first periphery radius 38, illustrated e.g. in FIGS. 2 and 4, at the recess portion is replaced by a small chamfered portion 44.

As mentioned above, the tip 20 is tightly fitted into the recess e.g. by shrink-fitting. A tip radius 23 is therefore substantially equal to the radius of the recess into which the tip 20 is fitted, i.e. the recess radius 40 discussed in conjunction with FIG. 4. A tip length 24 is illustrated. The tip length 24 can be e.g. at least 15 mm, at least 20 mm, at least 25 mm or at least 30 mm. The tip length 24 extends between the first tip end 21 and a second tip end 26.

As illustrated in FIG. 5, the first tip 21 end can be tapered with a first angle $\alpha$ relatively the longitudinal axis A of the tip 20 and the second tip end 26 can be tapered with a second angle $\beta$ relatively the longitudinal axis A of the tip 20.

Figure 6A:
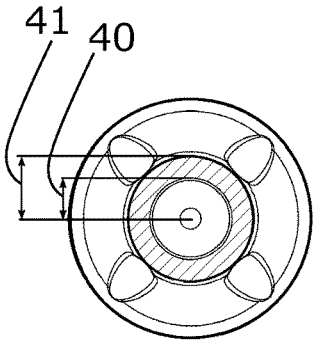
FIGS. 6*a*, 6*b* and 6*c* illustrate cross sectional views of the cutting tool according to some embodiments.
Figure 6B:
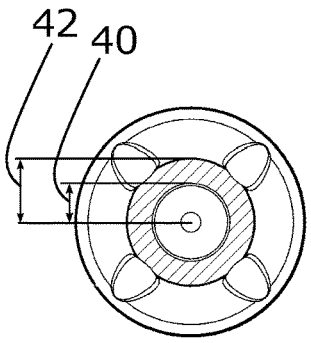
Figure 6C:
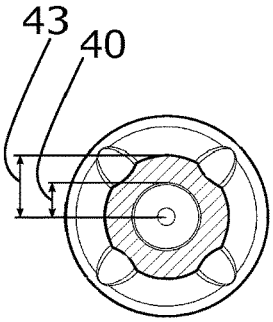

FIG. 6*a* illustrates a cross section of the cutting tool 10 at the first body radius 41 adjacent to the opening of the recess. In FIG. 6*b*, a cross section of the cutting tool 10 at the second body radius 42 at half the recess depth is illustrated. Furthermore, in FIG. 6*c*, a cross section of the cutting tool 10 at the third body radius 43 at the bottom of the recess is illustrated.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A cutting tool comprising a tip, a body and a shank for attaching the cutting tool to a tool holder, the tip having a tip radius and a tip length between a first end of the tip and a second end of the tip along a longitudinal axis of the tip, the body having a body radius and a body length between the shank and a recess portion along a longitudinal axis of the body, the recess portion comprising a wall which forms a recess with a depth into the body for retaining a major part of the tip length within the recess such that the longitudinal axis of the tip substantially coincides with the longitudinal axis of the body, wherein the body radius at half the depth of the recess is less than two times the tip radius, that the tip is made of a hard metal alloy with a hardness of at least 1300 HV50 and that the body is made of a steel alloy with a hardness of at least 450 HV30.

2. The cutting tool according to claim 1, wherein the body radius along the depth of the recess is less than two times the tip radius.

3. The cutting tool according to claim 1 wherein the body radius at half the depth of the recess is less than 1.7 times the tip radius.

4. The cutting tool according to claim 1 wherein the tip is made of a hard metal alloy with a hardness of at least 1350 HV50 and that the body is made of a steel alloy with a hardness of at least 465 HV30.

5. The cutting tool according to claim 1 wherein the tip is made of a hard metal alloy with a hardness of at least 1400 HV50 and that the body is made of a steel alloy with a hardness of at least 480 HV30.

6. The cutting tool according to claim 1 wherein the tip is made of a hard metal alloy with a hardness between 1400-1500 HV50 and that the body is made of a steel alloy with a hardness between 480-550 HV30.

7. The cutting tool according to claim 1 wherein the body radius increases continuously from the recess portion to the shank.

8. The cutting tool according to claim 7 wherein the body radius increases continuously from the recess portion to the shank along a smooth curve.

9. The cutting tool according to claim 1 wherein a periphery of the body comprises longitudinal grooves.

10. The cutting tool according to claim 1 wherein the recess comprises a wall portion and a bottom portion with a bottom-radius between the wall portion and the bottom portion.

11. The cutting tool according to claim 10 wherein the bottom radius is at least 1 mm.

12. The cutting tool according to claim 1 wherein the body comprises a ductile plate arranged in a bottom portion of the recess.

13. The cutting tool according to claim 1 wherein the tip is retained within the recess by shrink-fitting.

14. The cutting tool according to claim 1 wherein the first tip end is tapered with a first angle relatively the longitudinal axis of the tip, that the second tip end is tapered with a second angle relatively the longitudinal axis of the tip and that a cylindrical tip body extends between the first tip end and the second tip end.

15. The cutting tool according to claim 1 wherein the tip is made of diamond composite with a hardness of at least 1400 HV30.

* * * * *